US007100397B1

(12) United States Patent
Gratteau

(10) Patent No.: US 7,100,397 B1
(45) Date of Patent: Sep. 5, 2006

(54) BEVERAGE COOLER FOR A GOLF BAG

(76) Inventor: Robert H. Gratteau, 9614 Alisa Brooke, San Antonio, TX (US) 78254

( * ) Notice: Subject to any disclaimer, the term of this patent is extended or adjusted under 35 U.S.C. 154(b) by 0 days.

(21) Appl. No.: 11/204,584

(22) Filed: Aug. 16, 2005

(51) Int. Cl.
*F25D 3/08* (2006.01)

(52) U.S. Cl. ..... 62/457.5; 62/530

(58) Field of Classification Search ..... 62/457.4, 62/475.2, 457.5, 530; 220/739, 903
See application file for complete search history.

(56) References Cited

U.S. PATENT DOCUMENTS 4,459,827 A * 7/1984 Rhodes ..... 62/457.5
4,516,409 A 5/1985 Hobbs, Jr. et al.
D302,775 S 8/1989 Sinoff
4,908,248 A * 3/1990 Nakashima et al. ..... 428/35.5
4,910,977 A 3/1990 Hilton
4,924,682 A 5/1990 Penner
5,007,250 A * 4/1991 Musielak ..... 62/372
5,272,890 A 12/1993 Penxa
5,301,519 A 4/1994 Howorka
5,640,855 A 6/1997 Crescenzo et al.
5,722,253 A 3/1998 Todd
5,915,551 A * 6/1999 Vavro ..... 206/315.5
2005/0087538 A1 4/2005 Wolfe et al.

FOREIGN PATENT DOCUMENTS

CA 2225033 A1 3/1998

* cited by examiner

*Primary Examiner*—Melvin Jones
(74) *Attorney, Agent, or Firm*—Debra G. Shoemaker

(57) ABSTRACT

A cooler body that is of cylindrical shape and of an internal diameter and length to accommodate six prepackaged beverage containers stacked end-to-end. The cooler body is enclosed at the bottom with an end piece. The cooler also comprises a cooler top that is of the same diameter as the cooler body, the cooler top containing a coolant. The cooler top is enclosed at the top and enclosed at the bottom with a perforated end piece. A connector brings the cooler body and cooler top in close contact with each other. The cooler also provides a method for removal of beverages from the cooler including a band secured between the cooler body and the connector and running down to interior of the cooler to the bottom, up, and out of the cooler at the connector. When the user pulls on the band from the outside of the cooler, beverages within the cooler are thrust upwardly so that they may be easily taken out. A cylindrical piece fitting upon the band and of a length to fit within the internal diameter of the cooler body is provided to aid in movement of the stacked beverages.

9 Claims, 3 Drawing Sheets

BEVERAGE COOLER FOR A GOLF BAG

BACKGROUND OF THE INVENTION

1. Field of the Invention

The present invention relates to a beverage cooler for a golf bag for use in connection with providing a cooler to be placed in a golf bag to provide cold beverages to a golfer. The beverage cooler for a golf bag has particular utility in connection with providing cold beverage without removing the cooler from the golf bag but yet providing a cooler that can be removed from the bag as needed for cleaning or such.

2. Description of the Prior Art

The use of beverage coolers for a golf bags is known in the prior art. For example, U.S. Pat. No. 4,924,682 issued May 15, 1990 to Penner discloses a spring and a door to open the cooler. Penner discloses straps to secure the elongated coolers around a conventional golf bag. Penner also discloses a base plate 25 which is built into a bag or retrofitted.

U.S. Pat. No. 5,301,519 issued Apr. 12, 1994 to Howorka discloses a generally cylindrical cooler attached to a conventional golf bag. The cooler is made of lightweight layers, approximately 3 feet long. The bottom end has a protrusion for engaging an umbrella holder of a golf bag. Cooling units are adapted to be inserted into the housing.

U.S. Pat. No. 5,640,855 issued Jun. 24, 1997 to Crescenzo et al. discloses a cooler designed to fit within a side compartment of a golf bag. One side of generally rectangular shaped cooler is concave. An ice substitute is used to keep beverages cool.

Canadian Patent CA2,225,033A1 issued Mar. 3, 1998 to Whenham discloses a cooler that attached to a golfer's bag. The cooler is generally cylindrical and stored cooled soft drink cans of a standard size. The cooler is made of a light weight PVC pipe with Styrofoam insulation and a PVC cap. There are two hooks to attach the cooler to a golf bag. To remove sodas, the cap is dislodged, the cooler is taken off the golf bag and tipped over.

U.S. Pat. No. 3,263,806 issued Aug. 2, 1966 to Ring discloses a tubular container that arranges beverage bottles in an end-to-end relationship. A spring is used to assist in removing the cans.

U.S. Pat. No. 4,516,409 issued May 14, 1985 to Hobbs, Jr. et al. discloses a tubular contain with an internal storage passageway to arrange beverage cans in an end-to-end relationship. A spring is used to assist in removing the cans.

U.S. Pat. No. 4,910,977 issued Mar. 27, 1990 to Hilton discloses a cooler of thin walled tubular plastics which is closed at one end and has a removable lid at the other end. Cans are stacked and a disc with refrigerant material is placed between each can. A spring is used to assist in removing the cans.

While the above-described devices fulfill their respective, particular objectives and requirements, the aforementioned patents do not describe a beverage cooler for a golf bag that is placed inside a golf bag, where the cooler is made of water resistant materials and may be removed from the golf bag for cleaning or filling with beverage cans but further allows for beverage removal from the cooler without removing the entire cooler from the golf bag while on a golf course in the middle of a golf game. In particular, the devices of Penner, Howorka and Whenham are attached to the external side of a golf bag, not placed inside as the present invention. Placement of a cooler inside a golf bag has several advantages over placement of a cooler on the outside of a golf bag. In particular, a cooler on the outside of a golf bag may make the bag harder to maneuver and manage, or harder to balance. Further, a cooler placed on the inside of a golf bag is more discreet and out of the way than one attached to the outside. The device of Penner also required modification of the golf bag to use the cooler. The device of Crescenzo must be removed from the golf bag to remove a beverage. This requires the golfer to stop, reach down into a golf bag side pocket, unzip bags and coolers to remove a beverage and place the cooler back in the bag, interrupting the progress of the golfer and other golfers on the course. The device of Whenham must be turned upside down to remove beverages from the cooler, thus prohibiting discreet and easy removal of beverages from a cooler. The coolers of Ring, Hobbs, Jr. et al., and Hilton require a spring within the cooler to assist in removal of beverages from the cooler. Springs and several internal cooler parts may wear out over time and become damaged by water within the coolers.

Therefore, a need exists for a new and improved beverage cooler for a golf bag which can be used for supplying cool beverage to a golfer out on the course or in any location. In this regard, the present invention substantially fulfills this need. In this respect, the beverage cooler for a golf bag according to the present invention substantially departs from the conventional concepts and designs of the prior art, and in doing so provides a cooler for a golf bag for the purpose of providing a golfer the convenience of cold beverages on the golf course or elsewhere where the cold beverages can be removed from the golf bag without removal of the cooler from the golf bag.

SUMMARY OF THE INVENTION

In view of the foregoing disadvantages inherent in the known types of beverage cooler now present in the prior art, the present invention provides an improved beverage cooler for a golf bag and overcomes the above-mentioned disadvantages and drawbacks of the prior art. As such, the general purpose of the present invention, which will be described subsequently in greater detail, is to provide a new and improved beverage cooler for a golf bag which has all the advantages of the prior art mentioned heretofore and many novel features that result in a beverage cooler for a golf bag which is not anticipated, rendered obvious, suggested, or even implied by the prior art, either alone or in any combination thereof.

To attain this, the present invention essentially comprises a cooler body that is of cylindrical shape and of an internal diameter and length to accommodate six prepackaged beverage containers stacked end-to-end. The cooler body is enclosed at the bottom with a solid end piece. The cooler also comprises a cooler top containing a coolant that is of the same diameter as the cooler body. The cooler top is enclosed at the top and enclosed at the bottom with a perforated end piece. A connector brings the cooler body and cooler top in close contact with each other. The cooler also provides a method for removal of beverages from the cooler including a band secured between the cooler body and the connector, the band running down into the interior of the cooler to the bottom, up again, and out of the cooler at the connector. When the user pulls on the band from the outside of the cooler, beverages within the cooler are thrust upwardly so that they may be easily taken out of the cooler body. A cylindrical piece fitting upon the band and of a length to fit within the internal diameter of the cooler body is provided to aid in movement of the stacked beverages cans. Preferably the cooler uses a coolant such as ice cubes, a solid ice block or an ice substitute. Preferably the cooler is made of plastic, more preferably the cooler is made of PVC. Preferably the cooler is 3 inches in diameter, the cooler body is 32 inches in length and the cooler top is 8 inches in length. The beverage cooler of the present invention is preferably used in conjunction with a golf bag.

There has thus been outlined, rather broadly, the more important features of the invention in order that the detailed description thereof that follows may be better understood and in order that the present contribution to the art may be better appreciated.

There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved beverage cooler for a golf bag that has all of the advantages of the prior coolers for golf bags and none of the disadvantages.

It is another object of the present invention to provide a new and improved beverage cooler for a golf bag that may be easily and efficiently manufactured and marketed.

An even further object of the present invention is to provide a new and improved beverage cooler for a golf bag that has a low cost of manufacture with regard to both materials and labor, and which accordingly is then susceptible of low prices of sale to the consuming public, thereby making such beverage cooler for a golf bag economically available to the buying public.

Still another object of the present invention is to provide a new beverage cooler for a golf bag that provides in the apparatuses and methods of the prior art some of the advantages thereof, while simultaneously overcoming some of the disadvantages normally associated therewith.

Even still another object of the present invention is to provide a beverage cooler for a golf bag that provides a cooler that can fit in a golf bag so that fewer items need to be carried or looked after during a golf game.

Still yet another object of the present invention is to provide a beverage cooler for a golf bag where the cooler is discretely placed inside that golf bag.

In yet another object of the present invention is to provide a beverage cooler for a golf bag that is easily cleaned and easily removed from or placed into a golf bag as needed.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
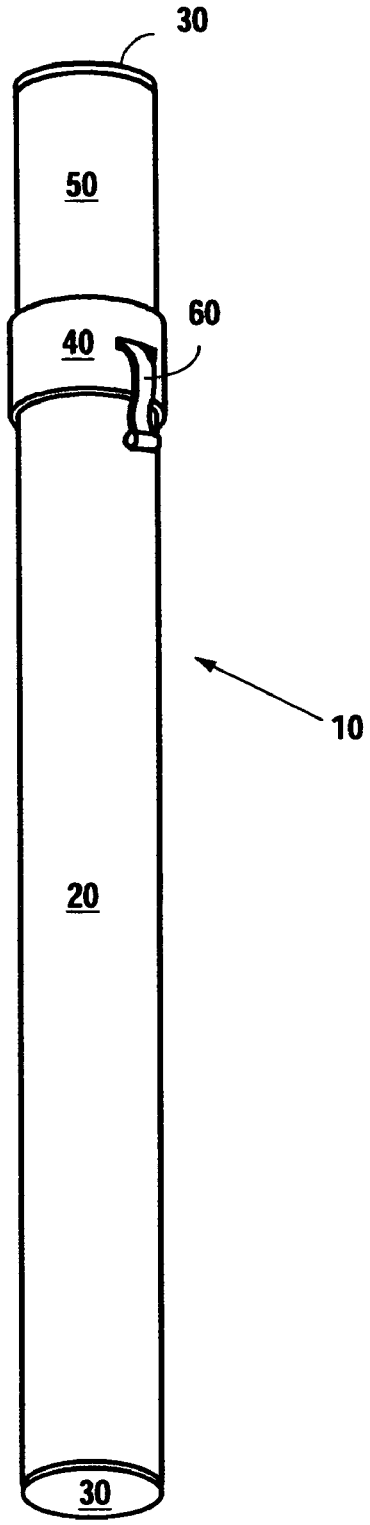
FIG. 1 is a perspective view of a preferred embodiment of the beverage cooler for a golf bag constructed in accordance with the principles of the present invention.

Referring now to the drawings, and particularly to FIGS. 1–7, a preferred embodiment of the beverage cooler for a golf bag of the present invention is shown and generally designated by the reference numeral 10.

Briefly, the beverage cooler for a golf bag according to the present invention, comprises a first cylindrical housing of an internal diameter and length to accommodate six prepackaged beverage containers stacked end-to-end, the housing having a top edge and a bottom edge, the bottom edge enclosed with a solid end piece; a second cylindrical housing to accommodate coolant, the second housing having a top edge and a bottom edge, the top edge enclosed with a solid end piece and the bottom edge enclosed with a perforated end piece; a connector having a first and second edges, the connector fitting the top edge of the first cylindrical housing at the first edge and fitting the bottom edge of the second cylindrical housing at the second edge, the connector having a slot through a connector wall at the approximate mid-point between the first and second edges of the connector; a band secured between the top edge of the first housing and the first edge of the connector at one end of the band, the band of a length sufficient to extend into the interior of the first cylindrical housing to the bottom, up to the top edge of the first cylindrical housing, and through the slot of the connector; a third cylindrical piece, fitting upon the band and of a length to fit within the internal diameter of the first cylindrical housing.

In FIG. 1, a new and improved beverage cooler for a golf bag 10 of the present invention will be described. As shown in FIG. 1, the beverage cooler according to the present invention provides a cooler body, or first cylindrical housing, 20 of dimensions to accommodate six prepackaged beverage cans stacked in an end-to-end configuration. A solid end piece 30 is provided at the bottom of the first cylindrical housing 20. A connector 40 is attached to the top of the first cylindrical housing 20. The beverage cooler according to the present invention provides a cooler top, or second cylindrical housing, 50 that holds a coolant such as ice cubes, a solid block of ice, or an ice substitute. The second cylindrical housing 50 fits in the connector 40 at a side opposite the first cylindrical housing 20. The beverage cooler according to the present invention provides a band 60 that can be pulled by the user from outside the cooler to raise beverage cans up the cooler body 20 of the cooler so that the beverage cans may easily be retrieved from the first cylindrical housing 20.

Figure 2:
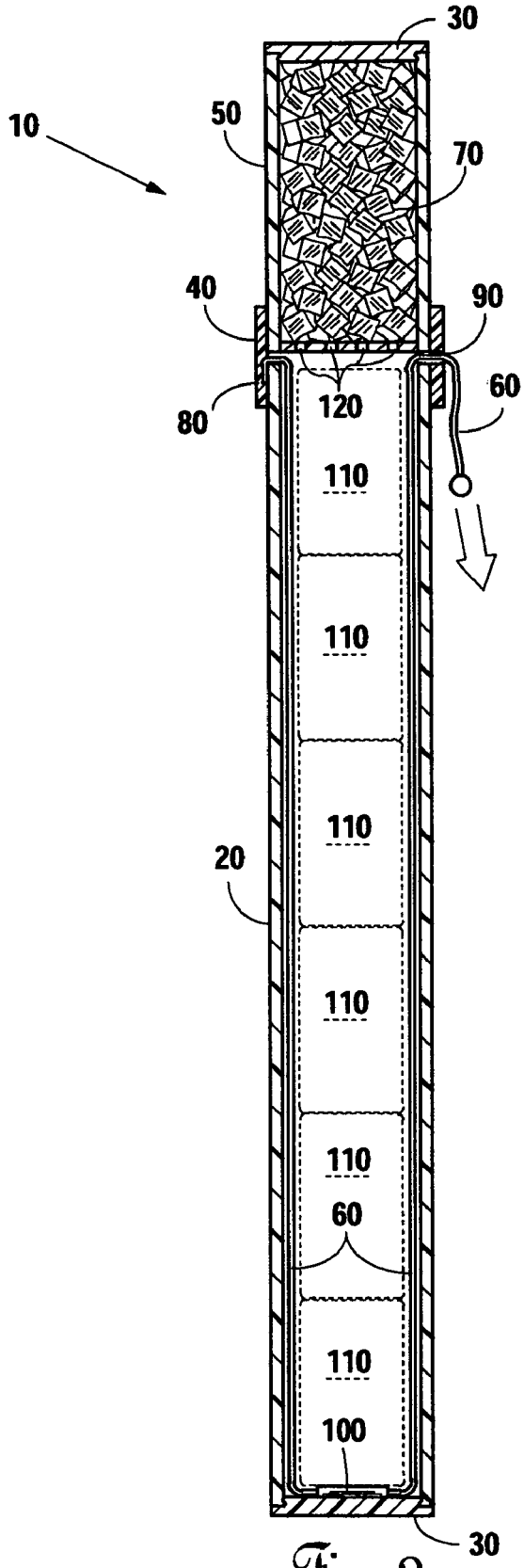
FIG. 2 is a cut away view of a preferred embodiment of the beverage cooler for a golf bag constructed in accordance with the principles of the present invention fully loaded with beverages and coolant.

The beverage cooler for a golf bag 10 of the present invention is shown in FIG. 2 fully loaded with beverages and coolant. In FIG. 2, the first cylindrical housing 20 is loaded with six prepackaged beverage containers 110 of a standard and similar size. The bottom edge of the housing 20 is fitted with a solid end piece 30. The solid end piece 30 is fitted into the bottom edge of the first cylindrical housing 20. The second cylindrical housing 50 is provided with a solid end piece 30 at the top edge of the second cylindrical housing 50 and a perforated end piece 120 at the bottom edge of the second cylindrical housing 50. A coolant is provided within the interior of the second cylindrical housing solid 50. Preferably, the second cylindrical housing 50 is filled with ice cubes, a solid block of ice, or an ice substitute 70. A connector 40 serves to bring the first 20 and second 50 cylindrical housings adjacent to each other so that there is close communication between the first 20 and second 50 cylindrical housings. The connector has a slot 90 located on one side of the connector to permit the band 60 to communicate from the inside of the cooler to the outside. The beverage cooler for a golf bag 10 of the present invention contains a band 60 that is secured between the connector 40 and the top edge of the first cylindrical housing 20 at one end 80 of the band. The band 60 then travels down the interior of the first cylindrical housing to the bottom, across the bottom and up the opposite side of the first cylindrical housing and is threaded through the slot 90 of the connector 40. When the user removes the second cylindrical housing 50 and pulls on the band 60 as shown by the arrow in FIG. 2, the beverages are thrust upwardly so that the beverage may be removed from the top edge of the first cylindrical housing 20. The beverage cooler for a golf bag 10 of the present invention is also provided with a third cylindrical piece 100. The third cylindrical piece 100 is hollow so as to fit upon the band 60. The third cylindrical piece 100 is of a size approximately the width of a prepackaged beverage can and will fit lengthwise inside the first cylindrical housing 20. The purpose of the third cylindrical piece 100 is to aid in the movement of the can within the first cylindrical housing 20 of the cooler.

Figure 3:
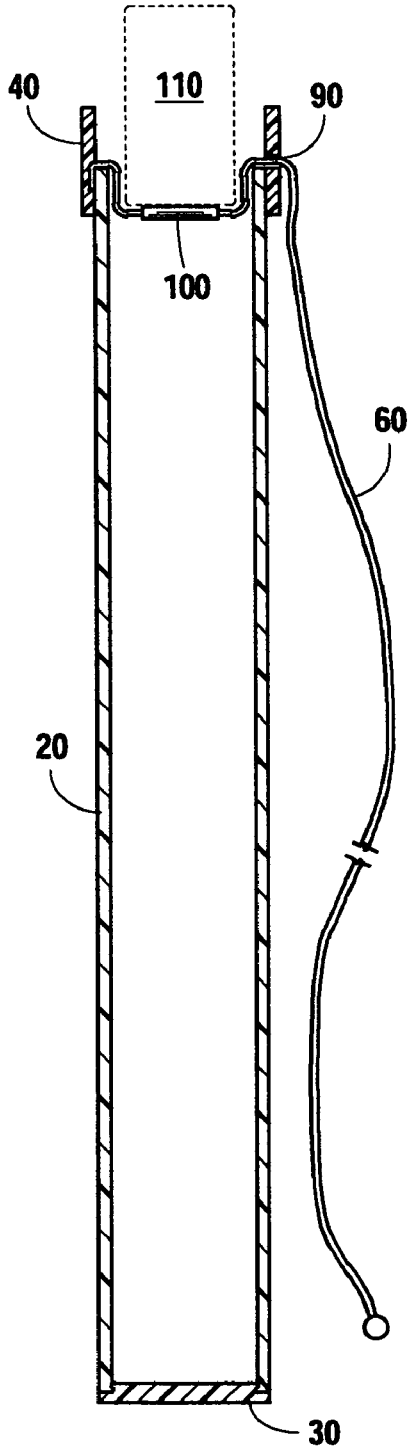
FIG. 3 is a cut away view of the cooler body of a preferred embodiment of the beverage cooler for a golf bag constructed in accordance with the principles of the present invention without beverages placed therein.

The beverage cooler for a golf bag 10 of the present invention is shown in FIG. 3 prior to loading of the prepackaged beverage containers therein. In particular the second cylindrical housing has been removed and the band 60 pulled out so that the third cylindrical piece 100 is near the top edge of the first cylindrical housing 20. To load the beverage cooler for a golf bag 10 of the present invention, a first prepackaged beverage 110 is placed upon the third cylindrical piece 100 and pushed downwardly as shown by the arrow in FIG. 3. The downward thrust will push the prepackaged beverage container 110 into the first cylindrical housing 20 and push the band 60 toward the bottom of the first cylindrical housing. When six prepackaged beverage containers 110 are loaded in the first cylindrical housing 20 a small amount of band 60 will remain outside the cooler to permit the user a means to remove the beverage containers from the cooler as desired.

Figure 4:
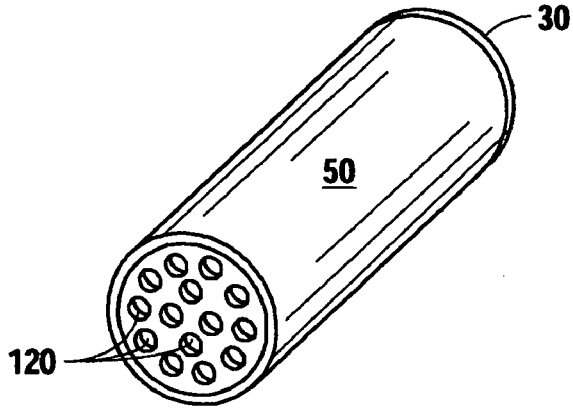
FIG. 4 is a side perspective view of the cooler top of a preferred embodiment of the beverage cooler for a golf bag constructed in accordance with the principles of the present invention.

Referring now to the second cylindrical housing 50 that contains a coolant such as ice or an ice substitute, FIG. 4 demonstrates a side perspective view of the cooler top, or second cylindrical housing, 50 of a preferred embodiment of the beverage cooler for a golf bag constructed in accordance with the principles of the present invention. In particular, the housing 50 is provided with a solid end piece 30 at the top of the cylindrical housing 50. This solid end piece 30 will prevent spillage of the coolant, such as ice or ice substitute, contained within the second cylindrical housing 50. The solid end piece 30 of the second cylindrical housing is similar to that placed at the bottom of the first cylindrical housing. The second cylindrical housing 50 is also provided with a perforated end piece 120 at the bottom of the second cylindrical housing 50. The perforated end piece 120 is in contact with the connector and thereby in close communication with the first cylindrical housing containing the prepackaged beverage containers. The perforated end piece 120 permits cold air to flow from the second cylindrical housing 50 to the first cylindrical housing thereby cooling the beverages contained therein.

Figure 5:
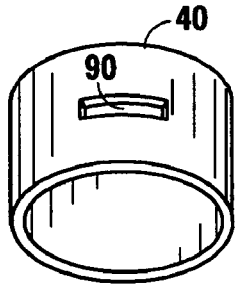
FIG. 5 is a side view of a connector of a preferred embodiment of the beverage cooler for a golf bag constructed in accordance with the principles of the present invention.

Referring now to the connector 40, FIG. 5 demonstrates side view of a connector 40 of a preferred embodiment of the beverage cooler for a golf bag constructed in accordance with the principles of the present invention. In particular, the connector 40 has a slot 90 located on one side of the connector 40 to permit the band (not shown in FIG. 5) to communicate from the inside of the cooler to the outside. The slot is of sufficient size to accommodate the band but also be of a small size so as to minimize escape of the cold air generated from the second cylindrical housing when the cooler is fully assembled. The slot goes all the way through one wall of the connector to permit the band a passageway between the interior of the cooler and the outside.

Figure 6:
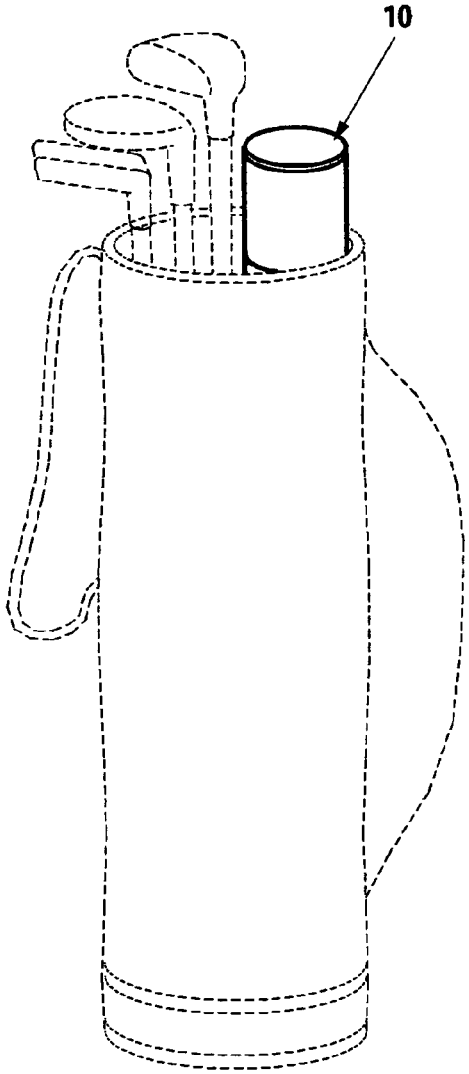
FIG. 6 is a perspective view of the beverage cooler of the present invention placed in a golf bag with golf clubs in accordance with the principles of the present invention.

FIG. 6 demonstrates a golf bag with clubs and the cooler placed therein. Further, although not shown in the Figure, if golf club covers are used, the second cylindrical housing of the beverage cooler for a golf bag constructed in accordance with the principles of the present invention can be fitted with a golf club cover similar to a golf club.

Figure 7:
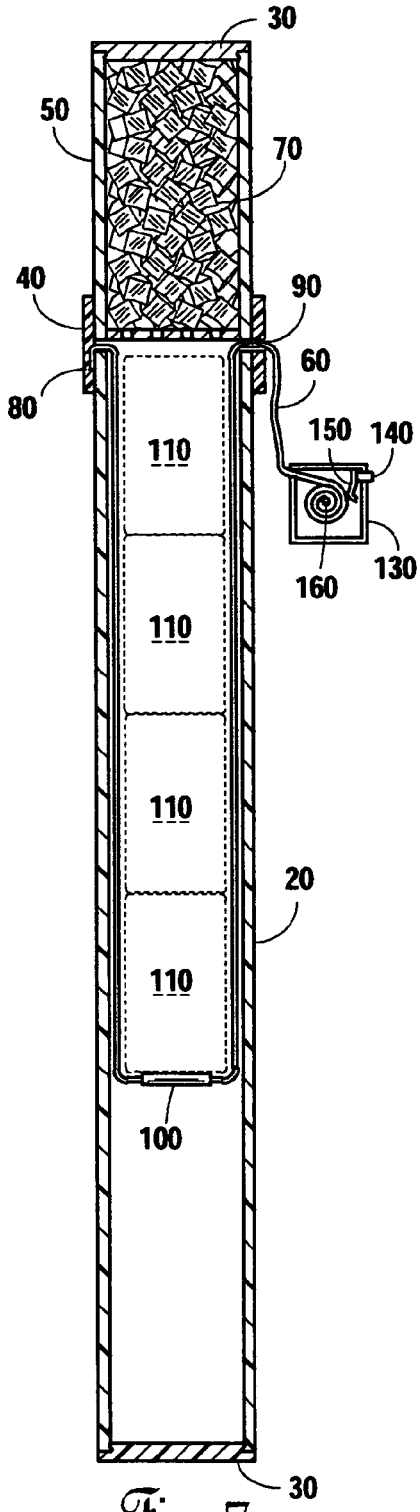
FIG. 7 is a cut away view of a preferred embodiment of the beverage cooler for a golf bag constructed in accordance with the principles of the present invention having a retractable banding housing.

FIG. 7 demonstrates yet another embodiment of the present invention. In this embodiment, the banding may be retractable. One end of the banding 80 would be secured between the connector 40 and first cylindrical housing 20 as described above, the banding 60 would enter the first cylindrical housing 20 and exit through the slot 90 of the connector 40. A small banding housing 130 would be placed outside the beverage cooler. The banding housing 130 could be permanently or removably attached to any part of the beverage cooler or it may not be attached at all. For convenience in drawing the Figure, the banding housing 130 is not attached to the beverage cooler in the Figure. Coolers where the banding housing 130 is attached to the cooler body are also encompassed by the present invention. The banding housing 130 would secure, inside the banding housing, the other one end of the banding 60. A spring 160 is provided to retract the banding 60. In addition, the housing 130 may be provided with means for retracting the banding. For example, the means for retracting the banding could include a lever 140 accessible to user from the outside of the banding housing, the lever 140 interacting with a stop means, such as a contact arm, 150 in contact with the banding. The stop means 150 will contact the banding and prevent movement of the banding. Depressing the lever 140 will remove the stop means 150 from contact with the banding, thus allowing the banding to be removed from the banding housing 130. This banding housing would work similar to a measuring tape. The band 60 could be extracted from the housing 130 as it was needed such as when prepackaged beverage cans are inserted into the first cylindrical housing 20, thus pushing the banding 60 out from the banding housing 130 and down into the first cylindrical housing 20. As the beverages are removed from the first cylindrical housing and the banding is not needed, the lever 140 is depressed or pushed thereby permitting removal of the stop means 150 from contact with the banding 60 thereby permitting the banding 60 to be retracted into the banding housing 130. The banding 60 could then be stored in the banding housing 130 when not in use.

In use, therefore it can be understood that the beverage cooler for a golf bag constructed in accordance with the principles of the present invention will be useful for providing cold beverages while playing golf. In particular, the second cylindrical housing will be removed from a fully assembled beverage cooler for a golf bag. The second cylindrical housing will be filled with coolant. The band 60 will be pulled until the third cylindrical piece is near the top edge of the first cylindrical housing. Prepackaged beverages will be placed upon the third cylindrical piece and pushed down into the first cylindrical housing. When fully loaded as desired the second cylindrical housing is placed on top and the entire cooler is placed into a golf bag with clubs and the golfing outing begins. The cooler top may be provided with a standard golf club cover for additional insulation. When a cool beverage is desired, the second cylindrical housing is removed and the band pulled to thrust upwardly a cold prepackaged beverage container from the cooler body. The second cylindrical housing is then placed upon the first cylindrical housing, the portion of the band that remain outside the cooler may be tucked up into the golf club cover or pushed down into the golf bag, left loose, or retracted into the banding housing. The beverage cooler for a golf bag of the present invention provides the golfer the ease of obtaining a cold beverage without having to remove the entire cooler from the golf bag. When the golf outing is over, the beverage cooler for a golf bag of the present invention can be removed from the golf bag and cleaned as needed. Since the beverage cooler for a golf bag of the present invention is made of durable, water resistant materials, the entire cooler may easily be washed out and dried.

As shown in the Figures, the first cylindrical housing 20, the second cylindrical housing 50, and the connector 40 are made of a solid material. Preferably the solid material insulates the inner atmosphere of the cooler to maintain a temperature cooler than the outer air and thereby maintain the beverages contained in the cooler at a cool temperature. The entire cooler is constructed of durable, water resistant materials. More preferably the components of the cooler are plastic, aluminum, or any other lightweight, water resistant materials. Insulation such as Styrofoam or the like may be added to the beverage cooler of the present invention provided the inside diameter of the first and cylindrical housings are the same and able to accommodate prepackaged beverage cans.

The coolant placed in the second cylindrical housing of the beverage cooler of the present invention is ice cubes, an ice block, or an ice substitute. The second cylindrical housing, or cooler top, of the cooler contains a coolant such as ice cubes, a large ice block, or an ice substitute. In one embodiment, the second cylindrical housing is provided with end pieces that are permanently attached and cannot be removed. In this case, the second cylindrical housing may be filled with tap water through the perforated end piece at the bottom of the cylindrical housing so that the cylindrical housing is nearly, but not completely full and the entire cylindrical housing placed in the freezer to form one large ice block within the second cylindrical housing. The cylindrical housing should not be completely full of water as water expands as it freezes. Preferably a water filled cooler top will be placed in a freezer for 48 hours to fully solidify. The beverage cooler for a golf bag of the present invention may be provided with two cooler top so that the golfer may use one of the cooler tops and have another in the freezer so that an cooler top full of ice is always on hand. Additional cooler tops may be provided as a companion piece to the beverage cooler for a golf bag of the present invention. As an alternative, the second cylindrical housing of the beverage cooler of the present invention may be provided with a perforated end piece that is removable so that the second cylindrical housing may be filled with preformed ice or an ice substitute. Or the perforated end piece of the second cylindrical housing is removed to fill the second cylindrical housing with water to place in the freezer for providing a large block of solid ice within the cooler top. The ice formed by freezing water in this manner would take up practically the entire interior surface area of the second cylindrical housing. It is especially important that the solid end piece placed on the top of the second cylindrical housing by water tight is water is to be placed in the second cylindrical housing for freezing. The perforated end piece may be provided with a means for aiding in the removal of the perforated end piece from the second cylindrical housing with the proviso that the means does not interfere with placement of the second cylindrical housing into the connector. In another alternative, the second cylindrical housing is filled with an ice substitute and both end pieces are permanently attached to the cylindrical housing since access to the ice substitute is not necessary. An ice substitute is any substance, chemical or physical, liquid or solid that is capable of cooling the interior of the beverage cooler of the present invention. In yet another alternative, the perforated end piece contains two pieces, one perforated end piece covering the end of the cylindrical housing as described above and another solid piece rotatably mounted over or under the perforated end piece so that the perforated holes may be covered or uncovered as needed. For example, if water is added to the second cylindrical housing and then needs to be moved, for example from a sink to a freezer, the user may desire to cover the holes of the perforated cap in order to present spills prior to freezing the water. The length of the second cylindrical housing may be varied depending upon the needs of the user. Preferably, the second cylindrical housing is capable of fitting into a sink under the tap, if the user wants to fill the housing with water. The second cylindrical housing may also preferably stand upright in any standard freezer of a household freezer/refrigerator. It will be appreciated however, that second cylindrical housings of any length may be provided. For example, a golf course that is supply beverage coolers to customers may use a commercial freezer of a different size and may accommodate larger or smaller cylindrical housings.

In a preferred embodiment, the first cylindrical housing and second cylindrical housing are made of 3 inch diameter PVC. The first cylindrical housing is 32 inches long and the second cylindrical housing is 8 to 11 inches long, more preferably 8 inches long. The connector is a 3 inch diameter PVC sleeve connector, the third cylindrical piece in one inch diameter PVC of approximately 1½ inches long. The end pieces and perforated end piece are three inch diameter end caps and the banding is six feet of a ¾ inch durable plastic banding. The perforated end piece contains approximately 25 holes each approximately ¼ inch in diameter. PVC materials have the advantage of being available in standard and compatible sizes, readily available, cost effective and water resistant. It will be appreciated that other plastics or other light weight water tight materials may be used to construct the beverage cooler of the present invention. For example, another type of plastic available in varying thicknesses or a light weight metal such as aluminum may be used. It may also be appreciated that the length of the various cooler components may be varied to meet the needs of the user. The size of the second cylindrical housing, for example may be varied as needed to fit an appropriate freezer space. In a preferred embodiment, the size of the second cylindrical housing is such that it may fit upright in a standard household freezer portion of a combinations freezer/refrigerator. The length of the first cylindrical housing may be varied to accommodate more or fewer prepackaged beverage cans or may be varied to accommodate a different sized or shaped beverage container as needed. The length and material of the band may be varied as needed to effective use of the cooler. In a preferred embodiment, the materials are waterproof, to prevent deterioration of the cooler components over time and to aid in washing out the cooler between uses to keep clean.

As shown in the Figures, the beverage cooler of the present invention accommodates six standard sized prepackaged beverage containers. The term prepackaged beverage container or prepackaged beverage can refers generally to a twelve ounce aluminum can containing soda or beer, the approximate dimensions of that can being 2½ inches by 5 inches. However, the terms prepackaged beverage container or prepackaged beverage can may refer to any beverage or food container of the appropriate diameter to fit into the beverage cooler of the present invention. For example, a glass bottle, a beer bottle, an extra large plastic soda bottle, a plastic food storage item may be added to the beverage cooler of the present invention. It is also possible to mix bottles and cans together in the cooler. An ice pack of the approximate size of a beverage can or bottle may be used in addition to the second cylindrical housing.

The entire beverage cooler of the present invention, the first and or second cylindrical housings, the connector, or a combination of pieces may be painted, or have stickers, a trademark, a logo or other lettering applied thereto. In one embodiment, only the connector is painted the color of a golfbag to make placement of the beverage cooler in the golf bag more pleasing to the eye but also save on cost because only a small portion of the entire beverage cooler would need to be painted. If the beverage cooler of the present invention is constructed of plastic, a plastic compatible paint should be used and the surface of the plastic beverage cooler should be prepared according to paint manufacturer instructions prior to paint application.

The solid and perforated end pieces may or may not form a water tight seal. In some instances it is desired that the first or second cylindrical housings be water tight, in other instances, the end pieces are removable to permit access to the interior. If it is determined that water tightness is not required, or non permanent placement of an end piece is desired, the end piece may simply be manually fitted into the first or second cylindrical housing. Placement of the solid end pieces and perforated end piece onto the cylindrical housings may be by glue, silicone, rubber cement, another adhesive, a bonding agent or any other appropriate means. In some embodiments it is preferred to make a water tight interior surface. In particular, the top solid end piece of the second cylindrical housing, when the second cylindrical housing will be placed upside down in a freezer with water inside must be watertight. In other embodiments no glue or sealant is needed because the solid or perforated end pieces need not be watertight. For instance, the perforated end piece of the second cylindrical housing may be removable and therefore would not be glued or sealed into the second cylindrical housing. The solid end piece placed on the bottom of the first cylindrical housing may or may not be permanently attached to the first cylindrical housing depending on the needs of the user. If a water tight first cylindrical housing is desired than the solid end piece should be permanently attached or secured to the bottom of the first cylindrical housing with glue, silicone, rubber cement, another adhesive, or any other appropriate means. However, since most golf bags are provided with a water resistant material in the bottom of the golf bag, the user may not desire a water tight seal between the solid end piece and the bottom of the first cylindrical housing. In one embodiment of the beverage cooler of the present invention, the end piece on the bottom of the first cylindrical housing can be left out. Since the cooler is provided with a band and a third cylindrical piece that can be pushed to the bottom of the cooler, the first cylindrical housing can be used without the end piece on the bottom and beverage containers will not fall out of the first cylindrical housing without an end piece. With respect to the perforated end piece, the pattern of perforation, the shape of perforation, and the diameter of each perforation may be varied to optimize flow of coolant into the first cylindrical housing from the second cylindrical housing. The solid end pieces of the second cylindrical housing and the first cylindrical housing may be the same or different.

The present invention provides a sturdy plastic band to aid in removal of beverage containers from the first cylindrical housing. The band is preferably attached to the outer surface of the top edge of the first cylindrical housing and the inner surface of the bottom edge of the connector. The band may be held in place by pressure introduced when the connector is placed on the first cylindrical housing. A glue, adhesive, rubber cement or bonding agent, screw or rivet may be added to the connector, band, or first cylindrical housing to additionally secure the band in place. The band may be of any appropriate construction provided the band can perform the task of moving into and out of the first cylindrical housing through the connector slot without wearing out, fraying or breaking. Preferably the band is a plastic banding. The thickness, width, length and material of the banding may be varied as needed by the user. In one preferred embodiment, six feet of ¾ plastic banding are used. The banding may be equipped with a handle or loop or attachment at the end of the housing that is opposite the end secured between the connector and first cylindrical housing. The handle, loop or attachment may be used to aid in pulling the band to thrust upwardly beverage cans located in the first cylindrical housing. The handle, loop or attachment may be used to help in carrying the beverage cooler or placing the beverage cooler in and out of a golf bag. The handle, loop or attachment may be in the form of a grip or a golf ball shaped circular object. The handle, loop or attachment may be attached to and/or through the banding with glue, silicone, and rubber cement, another adhesive, bonding means, Velcro™ or any other appropriate means. In another embodiment, the banding may be retractable. In this case, one end of the banding would be secured between the connector and first cylindrical housing as described above, the banding would enter the first cylindrical housing and exit through the slot of the connector. A banding housing would be placed outside the beverage cooler. The banding housing could be permanently attached to any part of the beverage cooler or it may not be attached at all. The housing would secure, inside the housing, the other one end of the banding. In addition, the housing may be provided with means for retracting the banding such as a spring, and lever connected to a stop means. This housing would work similar to a measuring tape. The band could be extracted from the housing as it was needed, such as when beverage cans are inserted into the first cylindrical housing, thus pushing the banding down into the first cylindrical housing. As the beverages are removed from the first cylindrical housing and the banding is not needed, the banding housing could be used to retract the banding for storage.

The connector and first cylindrical housing sealed may be attached to each other in any appropriate manner. Preferably the connector is placed onto the first cylindrical housing, with the band in place, and held in place by pressure or friction. As an alternative, glue, silicone, rubber cement, or any adhesive or screw or rivet or the like may be used to connect the connector to the first cylindrical housing. The second cylindrical housing fits into the connector so that the first cylindrical housing and the second cylindrical housing are in close communication. Preferably, the second cylindrical housing is easily removed from the connector and first cylindrical housing element and the connector and first cylindrical housing function together as a unit.

The present invention also comprising a cooler with a cover covering the second cylindrical housing. The second cylindrical housing of the cooler of the present invention may be covered a standard golf club cover. Placement of a golf club cover on the second cylindrical housing provides added insulation to keep the coolant, such as ice or ice substitute, contained there colder for a longer period of time. Further placement of the golf club cover on the cooler permits the cooler to be discrete, covert and more attractive. The second cylindrical housing may be covered with any cover of the correct dimensions. As an alternative, the cover could be permanently attached to the second cylindrical housing, or may be attached to the second cylindrical housing with snaps, Velcro™, or the like. The cover could include any letter, trademarks, and logos as desired and be of any color to compliment a golf bag and other accessories. The cover may be cloth or any other appropriate material.

The beverage cooler for a golfbag of the present invention may be equipped with a handle or strap to aid in movement or carrying the cooler in and out of a golfbag or from location to location. The cooler housing may be modified with anchors at any location capable of receiving a clip, latch, snap, S hook or hook attached to a handle or strap, or Velcro™ may be used for this purpose. The first and second cylindrical housing may each be provided with a tether to attach first and second cylindrical housings together so that one will not be lost. The tether may include anchors and hooks, snaps, latch, clips, or Velcro™ may be used for this purpose.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A beverage cooler for a golf bag comprising:

a first cylindrical housing of an internal diameter and length to accommodate six prepackaged beverage containers stacked end-to-end, the housing having a top edge and a bottom edge, the bottom edge enclosed with a solid end piece;

a second cylindrical housing to accommodate coolant, the second housing having a top edge and a bottom edge, the top edge enclosed with a solid end piece and the bottom edge enclosed with a perforated end piece;

a connector having a first and second edges, the connector fitting the top edge of the first cylindrical housing at the first edge and fitting the bottom edge of the second cylindrical housing at the second edge, the connector having a slot through a connector wall at the approximate mid-point between the first and second edges of the connector;

a band secured between the top edge of the first housing and the first edge of the connector at one end of the band, the band of a length sufficient to extend into the interior of the first cylindrical housing to the bottom, up to the top edge of the first cylindrical housing, and through the slot of the connector;

a third cylindrical piece, fitting upon the band and of a length to fit within the internal diameter of the first cylindrical housing.

2. The beverage cooler of claim 1, wherein the coolant is ice cubes, an ice block, or an ice substitute.

3. The beverage cooler of claim 1, further comprising a retractable banding housing, the banding housing having a lever, stop means, and a spring.

4. The beverage cooler of claim 1, further comprising a cover covering the second cylindrical housing.

5. The beverage cooler of claim 1, where the first cylindrical housing, second cylindrical housing, or connector are painted.

6. The beverage cooler of claim 1, wherein:

the first cylindrical housing is 3 inches in diameter and 32 inches in length;

the second cylindrical housing is 3 inches in diameter and 8 inches in length;

the connector is a 3 inch diameter sleeve connector;

the third cylindrical piece is one inch in diameter, hollow and 1½ inches in length;

the end pieces and perforated end piece are three inch diameter caps; and the banding is six feet of a ¾ inch plastic.

7. The beverage cooler of claim 1, wherein, the first cylindrical housing, second cylindrical housing and third cylindrical piece, connector, solid end pieces and the perforated end piece are plastic.

8. The beverage cooler of claim 1, wherein, the first cylindrical housing, second cylindrical housing and third cylindrical piece are PVC, the connector is a PVC sleeve connector, the end pieces and the perforated end piece are PVC end caps.

9. A beverage cooler according to claim 1 and a golf bag.

* * * * *